US008973315B2

(12) United States Patent
Massey

(10) Patent No.: US 8,973,315 B2
(45) Date of Patent: Mar. 10, 2015

(54) WINDOW TRIM SYSTEM

(71) Applicant: Milgard Manufacturing Incorporated, Taylor, MI (US)

(72) Inventor: Victor Massey, Orting, WA (US)

(73) Assignee: Milgard Manufacturing Incorporated, Tacoma, WA (US)

( * ) Notice: Subject to any disclaimer, the term of this patent is extended or adjusted under 35 U.S.C. 154(b) by 0 days.

(21) Appl. No.: 13/724,222

(22) Filed: Dec. 21, 2012

(65) Prior Publication Data

US 2014/0174007 A1 Jun. 26, 2014

(51) Int. Cl.

| | |
|---|---|
| ***E04B 1/38*** | (2006.01) |
| ***E06B 3/96*** | (2006.01) |
| ***E06B 1/56*** | (2006.01) |
| ***E06B 1/34*** | (2006.01) |
| ***E06B 1/36*** | (2006.01) |

(52) U.S. Cl.

CPC .... *E06B 1/36* (2013.01); *E06B 1/34* (2013.01)
USPC ..... 52/204.53; 52/210; 52/213; 52/655.1; 52/656.5

(58) Field of Classification Search

USPC ..... 52/204.53, 204.5, 204.55, 204.61, 52/204.54, 204.59, 210–214, 656.5, 655.1
See application file for complete search history.

(56) References Cited

U.S. PATENT DOCUMENTS

| | | | | |
|---|---|---|---|---|
| 3,975,875 | A | 8/1976 | Goss, Jr. | |
| 4,193,238 | A | 3/1980 | Chalmers et al. | |
| 4,433,517 | A * | 2/1984 | Moore, Jr. | 52/204.55 |
| 4,972,640 | A | 11/1990 | Difazio | |
| 5,740,650 | A * | 4/1998 | Seiber et al. | 52/584.1 |
| 6,044,611 | A * | 4/2000 | Brunett | 52/656.5 |
| 6,829,865 | B2 | 12/2004 | Smith | |
| 6,883,277 | B2 * | 4/2005 | Wiechecki et al. | 52/36.6 |
| 8,607,504 | B2 * | 12/2013 | Peeters Weem | 49/360 |
| 2005/0178079 | A1 * | 8/2005 | Hardman et al. | 52/208 |
| 2011/0005153 | A1 * | 1/2011 | Schield | 52/204.53 |

FOREIGN PATENT DOCUMENTS

GB 2187499 A * 9/1987

* cited by examiner

*Primary Examiner* — Jeanette E. Chapman
(74) *Attorney, Agent, or Firm* — Rathe Lindenbaum LLP

(57) ABSTRACT

A trim assembly comprising a clip having a body including a first portion configured to be receivably removed within a slot of an architectural member and a second portion configured to removably secure a trim element. The second portion includes a spring biased member biasing the trim element.

17 Claims, 11 Drawing Sheets

FIG. 10
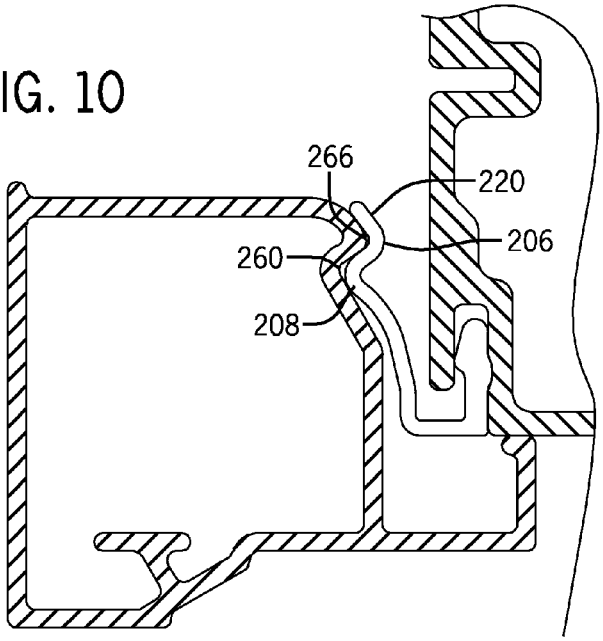
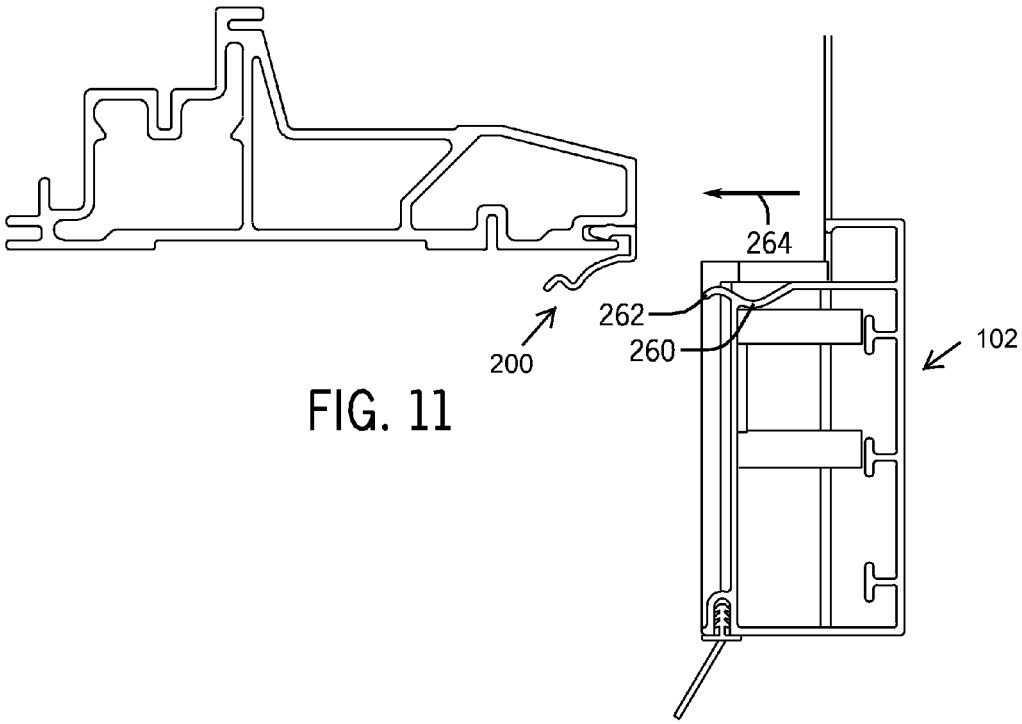
FIG. 11

WINDOW TRIM SYSTEM

CROSS-REFERENCE TO RELATED PATENT APPLICATIONS

None.

BACKGROUND

Trim is used in a variety of building applications to frame architectural elements of a building. Trim may be sued to finish and surround doorways, windows, patio doors, garage doors and other types of architectural elements that define openings to a building structure. Trim is applied to frame the architectural elements windows on site and may be secured with tools and fasteners such as a hammer and nails.

SUMMARY

In one embodiment a window and trim assembly system include a window structure including a window frame having a first longitudinal edge and a second opposing longitudinal edge. A trim assembly surrounds a periphery of the window structure having a decorative surface and an opposing surface having an engagement portion. The trim assembly has a first portion proximate the first longitudinal edge and a second portion proximate the second longitudinal edge. A first clip is releasably engaged with the window structure adjacent the first longitudinal edge and a second clip being releasably engaged with the window structure adjacent the second longitudinal edge. The first clip and second clip releasably secure the trim assembly to the window structure. The first clip biases the first portion of the trim assembly in a first direction and the second clip biases the second portion of the trim assembly in a second direction opposite to the first direction. The first clip and second clip are releasably engaged with the window structure and trim assembly without a fastener and without a tool.

In another embodiment a method for attaching a trim assembly to a window comprises forming a trim assembly by creating a frame having an engagement member that support the weight of the frame. Providing a plurality of clips to mate with the engagement member. Releasably securing the clips to a window structure without a fastener or tool. Positioning the trim assembly substantially parallel to the surface of a window structure. Aligning the engagement member of the trim frame with the clips. Hand pressing the trim assembly such that all tabs are inserted onto the clips to releasably secure the trim assembly and center the trim assembly relative to the window frame by biasing the trim assembly in a first direction by one of the plurality of the clips and in a second opposing direction by another of the plurality of the clips.

BRIEF DESCRIPTION OF THE DRAWINGS

FIG. 10 is a top view of a trim piece aligning with a mounted (to a window) clip, ready to be attached to the clip (and window).

FIG. 11 is a top view of a trim piece inserted and attached to a clip and two sides of a window.

DETAILED DESCRIPTION OF THE EXAMPLE EMBODIMENTS

Figure 1:
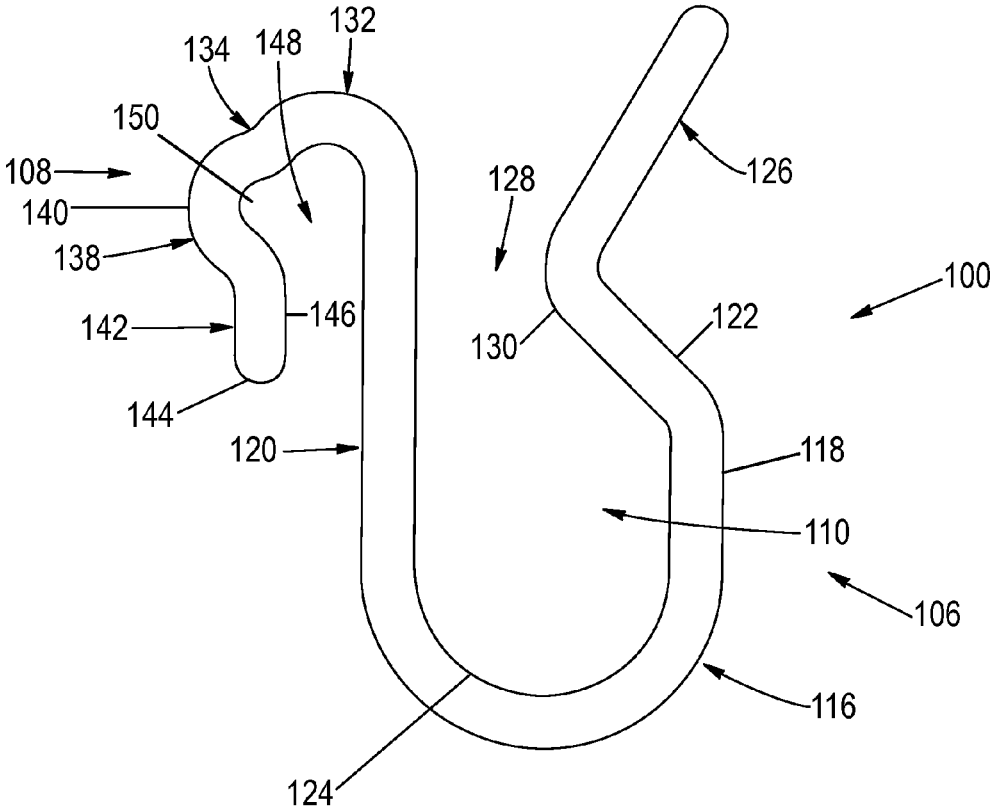
FIG. 1 is an isometric view of a clip.
Figure 2:
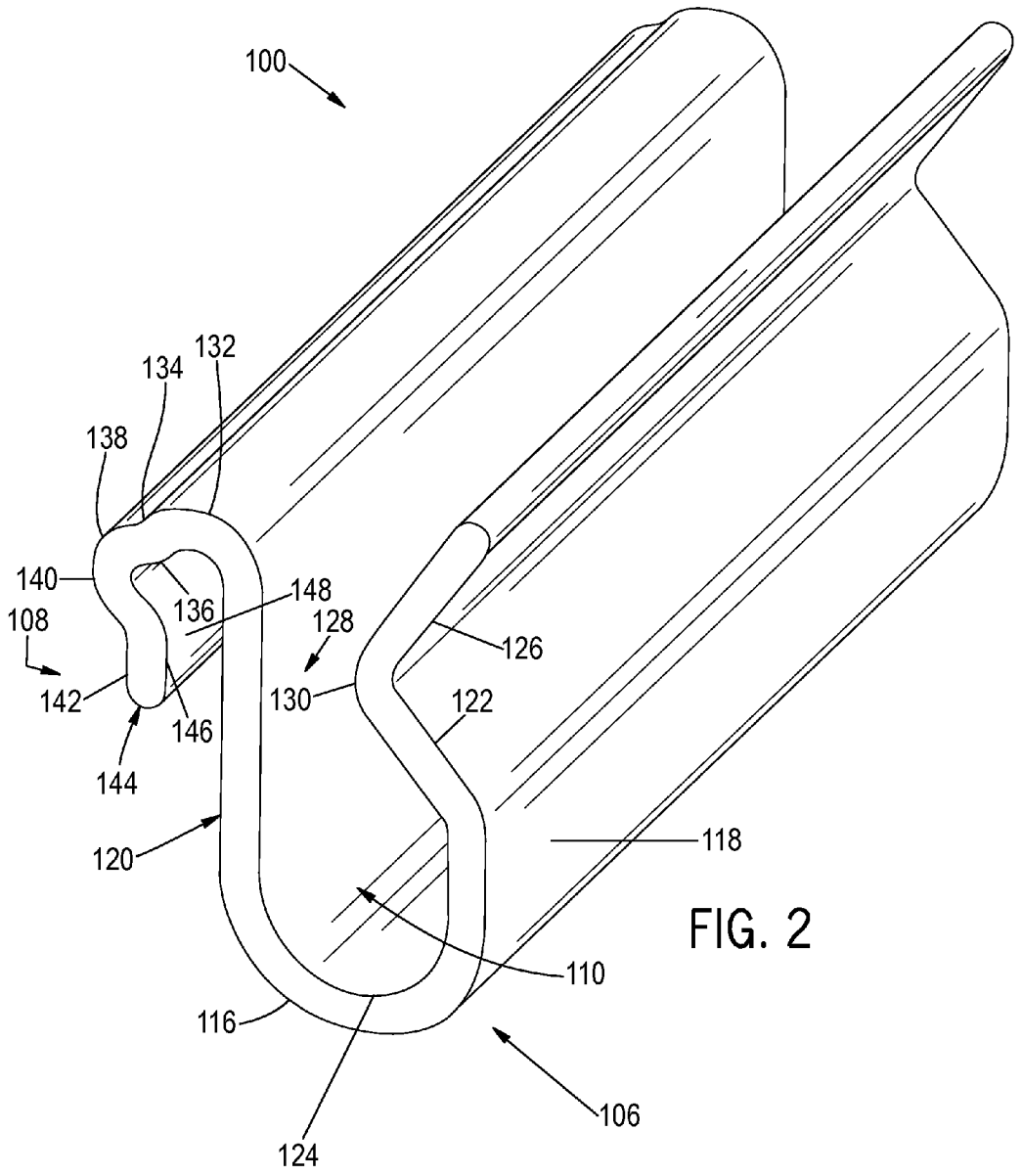
FIG. 2 is a cross-sectional view of the clip of FIG. 1.
Figure 3:
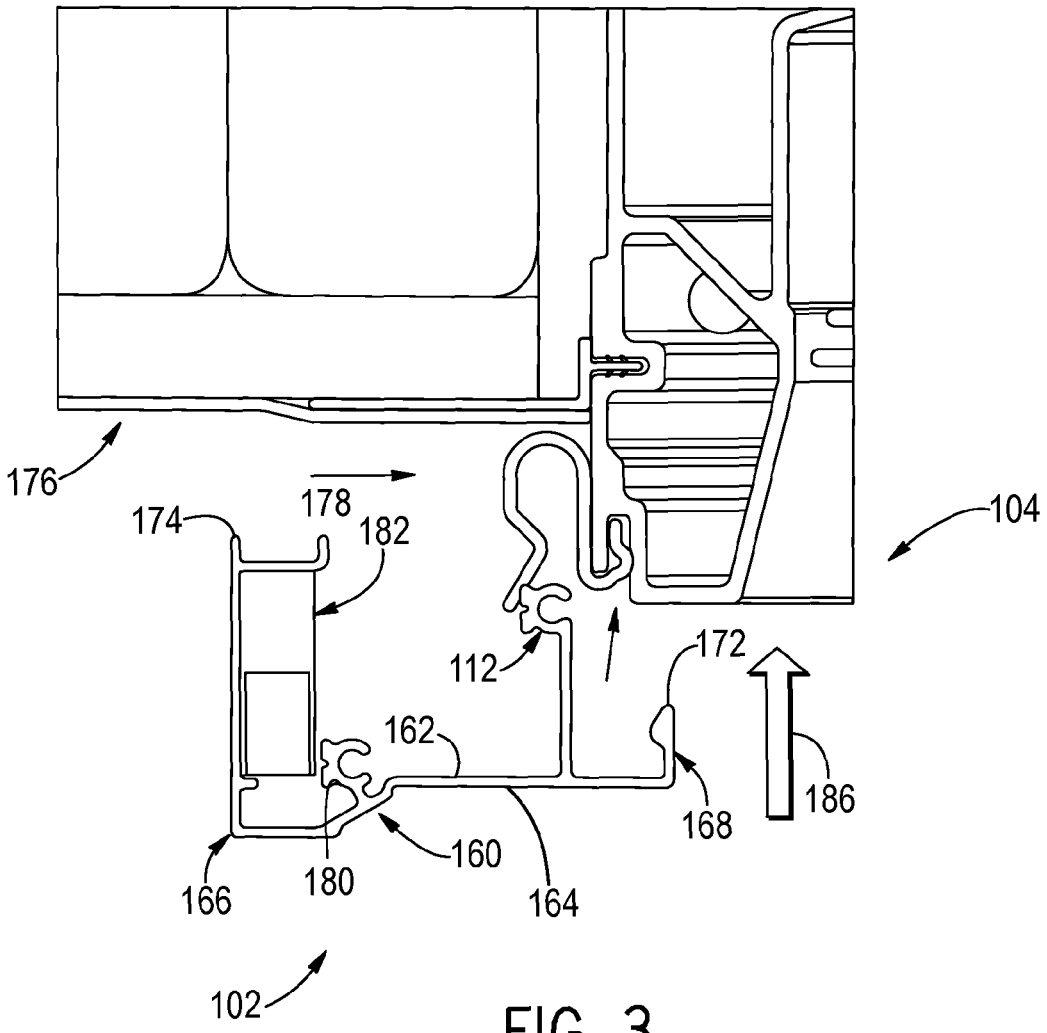
FIG. 3 is a cross-sectional view of the clip, trim assembly, building and window, prior to installation of the trim.

Referring to FIGS. 1, 2 and 3, a clip 100 releasably secures a trim assembly 102 to an architectural element such as a window structure 104. Clip 100 includes a first portion 106 and a second portion 108. In one embodiment, clip 100 is molded or formed as a one-piece device. First portion 106 defines a cavity 110 to releasably secure a tab 112 of trim assembly 102. Trim assembly 102 may be a single trim member or a number of trim members that are secured to one another to form a frame about a window for example.

In one implementation, cavity 110 has a cross sectional area that is larger than the cross sectional area of tab 112. First portion 106 is connected to second portion 108 by a U-shaped portion 116. U-shaped portion 116 includes a first leg 118 and an opposing second leg 120 connecting the first portion 106 to the second portion 108. First portion 106 includes an inwardly extending leg 122 extending inwardly from first leg 118 in a direction toward cavity 110 and away from a bottom portion 124 of the U-shaped portion 116.

An outwardly extending guide portion 126 extends from inwardly extending leg 122 in a direction away from cavity 110. Guide portion 126 provides a guide for tab 112 toward an opening 128 of cavity 110. A tooth portion 130 is formed at the intersection of inwardly extending leg 122 and guide portion 126.

In one embodiment, guide portion 126 extends from inwardly extending leg 122 at a right angle. However, other angles less than 180 degrees are also contemplated. Guide portion 126 provides funnel guidance for the tab 112 to be easily inserted into cavity 110 through opening 128. As discussed below, clip 100 has spring like properties, such that leg 118 and leg 122 are flexed outwardly away from cavity 110 as tab 112 is inserted into cavity and then springs back toward cavity 110 once tab 112 passes through opening 128.

FIGS. 1 and 2 show the second portion 108 comprising a J-shaped leg 132 that is attached to second leg 120 of U-shaped portion 116. In one implementation, a concave leg 134 extends from J-shaped leg 132 having a point of inflection 136. A convex bulge portion 138 extends from concave leg portion 134. Convex bulge portion 138 has an outer surface 140 having a maximum distance from leg 120. Extending from convex bulge portion 138 is a terminal leg portion 142 extending substantially parallel to second leg 120 has a terminal free end 144. Terminal leg portion 142 includes an inner surface 146 facing second leg 120. Inner surface 146 is a spaced a predetermined distance from outer surface 140 of bulge portion 138.

A bay 148 is defined by the region between second leg 120, J-shaped leg 132, concave leg portion 134, convex bulge portion 140 and terminal leg portion 142. A notch 150 is located within bay 148 defined by the convex leg portion 140 defining a concave notch 150. Concave leg portion 134 of clip 100 provides flexibility for leg portion 142 of clip 100.

Figure 5:
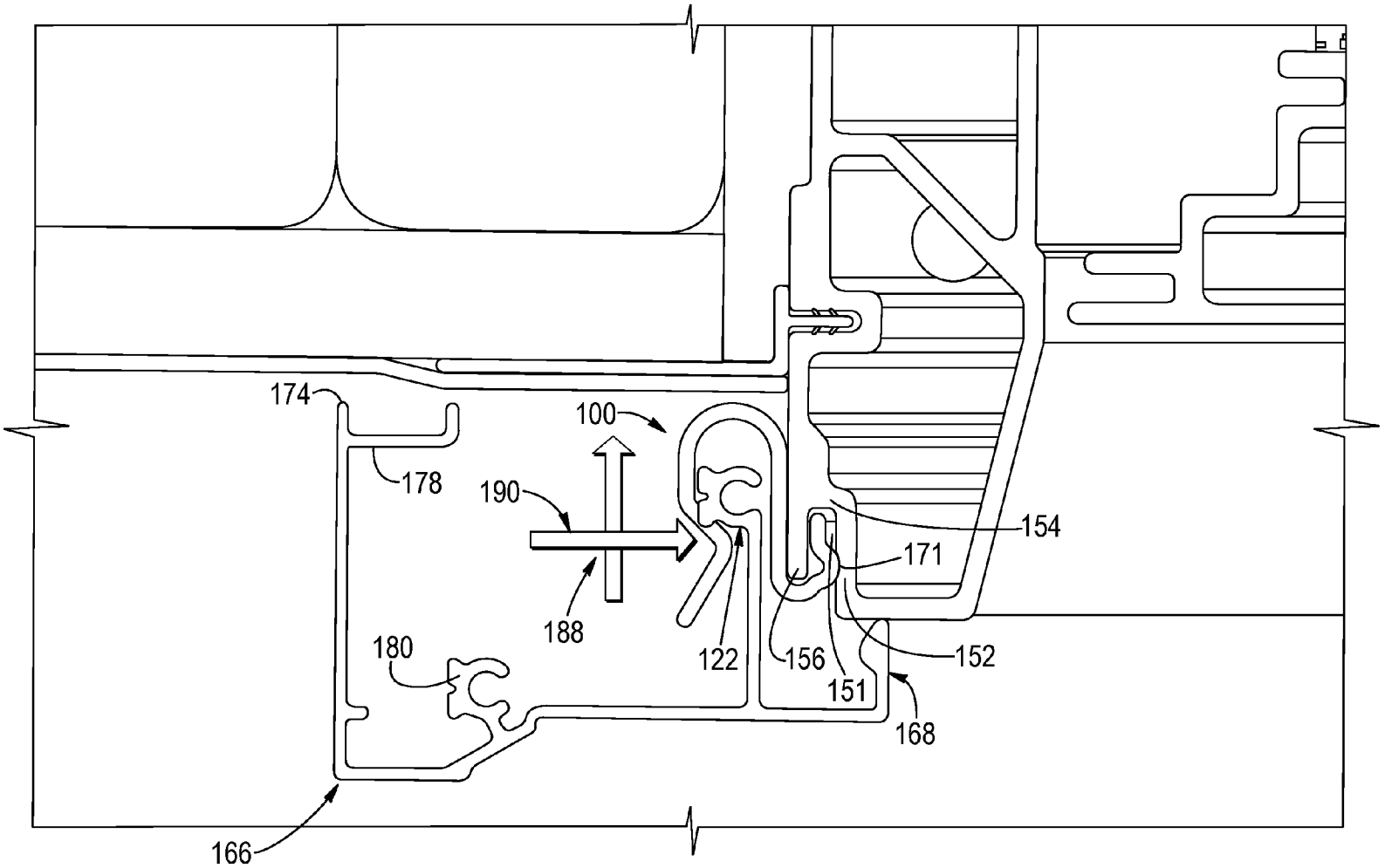
FIG. 5 is an isometric view of a trim assembly prior to installation to a pair of windows.

Referring to FIG. 2 and FIG. 5 second portion 108 of clip 100 is receiveably secured to window structure 104. Groove 151 is defined as U-shaped where the open end is opposite of the majority portion of the window 104. In one embodiment, groove 151 includes a first wall 152, connected to a bottom leg portion 154. The bottom leg portion 154 is connected to a second opposing wall or post 156. In this embodiment, the first wall 152 is longer than the opposing wall or post 156. Referring to FIG. 5 post 156 does not extend as far as wall 152 from the base of groove 151. However it is also contemplated that post 156 may extend as far as or further than wall 152 from the base of groove 151.

Terminal leg 142 and bulge portion 138 are received within groove 151 while a free end of second wall 154 is received within bay 148. Second portion 108 is removably secured to window structure 104 by a user without the need for any tools. A user simply pushes second portion 108 toward second wall 154 until post 156 is received within bay 148. As post 156 is received within bay 148, terminal leg 142 and bulge portion 138 are received within groove 151. In one implementation, opening 158 into bay 148 has a distance that is less than the thickness of post 156. As a result as the free end of second wall 154 moves into bay 148 terminal leg portion 142 flexes in a direction away from second leg 120 of the U-shaped leg portion of clip 100. J-shaped leg portion 132 acts as a spring to bias the terminal leg portion against post 156 of groove 151.

In one implementation the distance between the facing surfaces of first wall 152 and post 156 of groove 151 is a first distance that is less than the distance of a vector extending perpendicularly between outer surface 140 of bulge portion 138 and the inner surface 146 of terminal leg portion 142. As a result, when second portion 108 is pushed into groove 151 of window structure 104 bulge portion 138 flexes in a spring like manner such that the distance between outer surface 140 and inner surface 146 is the same as the first distance between the facing surfaces of first wall 152 and post 156. In this manner the spring force provided by the flexing of bulge portion 138 assists in maintaining clip 100 within groove 151 as well as pressing terminal leg portion 142 against second wall 154 to maintain a grip onto post 156 with second leg portion 120 of the U-shaped portion of clip 100.

In a different embodiment, post 156 can be P-shaped. The entire 'P' or nub may bit snuggly within the notch 150. This type of configuration would provide additional security to the window frame 104, but could require additional hand force to be removed.

Clip(s) 100 are made of material that is sufficiently pliable to provide the necessary spring force to maintain clips 100 within respective bays 148 and to secure tabs 112 of trim assembly 102 within cavity 110.

Figure 4:
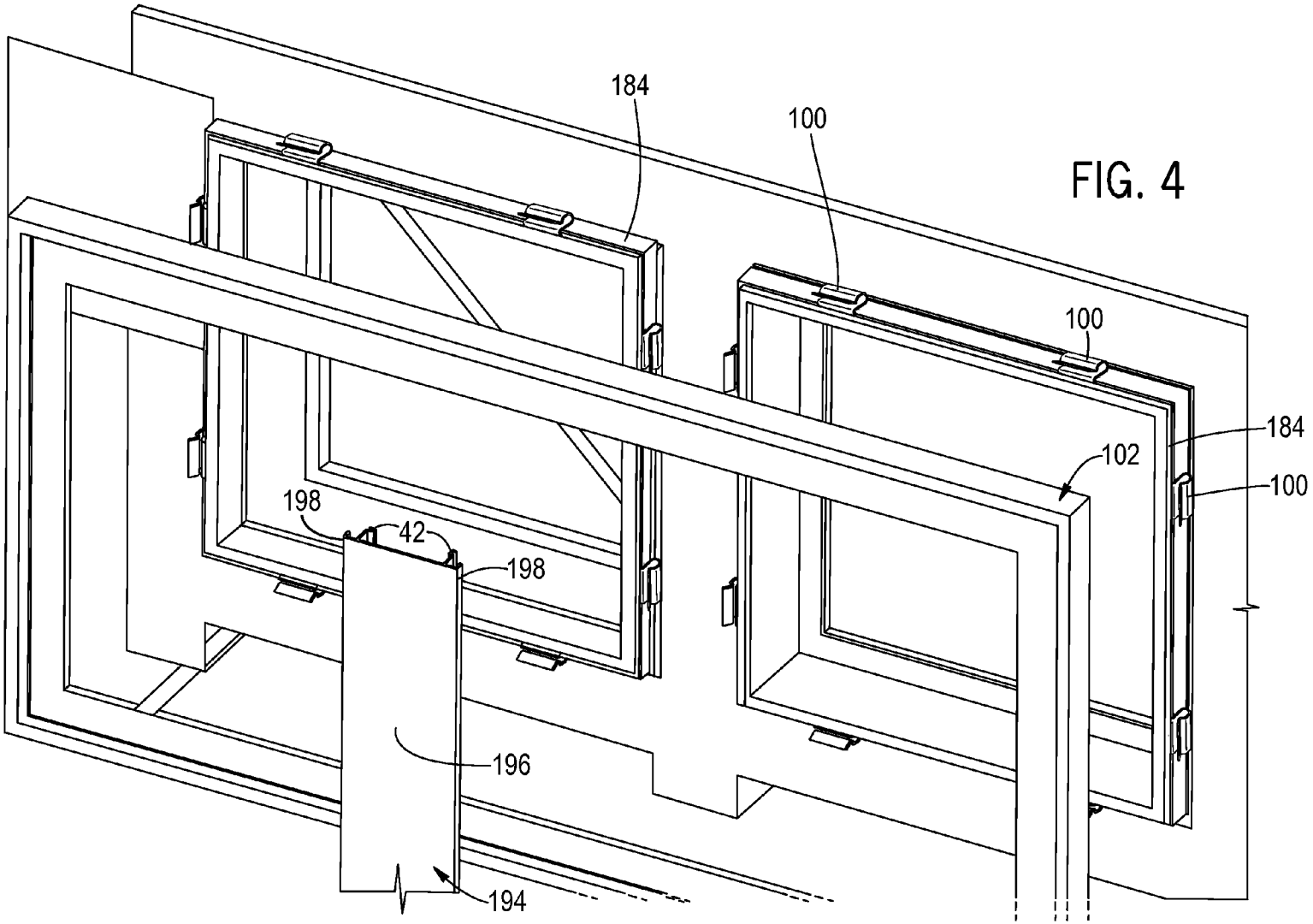
FIG. 4 is a cross-sectional view of the clip, trim assembly, building and windows after installation of the trim.

The material needs to be pliable enough to bend to accept and then envelop securely a tab 112. However, the material should be resistive to the weight of a trim assembly 102 and reasonable environmental conditions surrounding the trim assembly 102 once the trim assembly 102 is installed. The trim assembly 102 can be of any form. FIG. 4 shows non-limiting examples of a rectangular and mull casting trim assemblies 102.

FIG. 3 shows the top view of the insertion process of the trim assembly 102 to a clip 100. The trim assembly 102 comprises an outer surface 160 and an opposing inner surface 162. Trim assembly includes a main panel 164, an outer panel 166 and an inner panel 168. A post 170 extends from inner surface 162 in a direction away from the outer surface 160. Tab 112 extends from a terminal end of post 170 spaced from inner surface 162.

In an optional addition, a channel 171 may be added to the window structure 104. The channel 171 is designed to provide an embracing surface for bulge portion 138. This will provide greater frictional contact; thereby, provide addition support for the clip 100 and the trim assembly 102.

Inner panel 168 includes a free end 172 that may serve as a stop against an outer surface of window structure 104. Outer panel 166 includes a free terminal end 174 which is located proximate building structure 176 when trim assembly 102 is secured to window structure 104. Referring to FIG. 4, free end 172 of inner panel 168 contacts a surface of window structure 104 when trim assembly 102 is secured with clips 100 to window structure 104. Additionally, free end 174 of outer panel 166 is spaced from an outer surface of building structure 176.

Outer panel 166 includes a supporting leg portion 178 and an inner tab member 180 designed to attach corner key 182 to secure two trim members together such as at a corner. As noted above in one embodiment, supporting leg 178 normally does not make contact with the building structure 176, thereby, a gap 178 is created. This gap 178, allows additional flexibility and tolerance when the user is inserting the trim assembly 102 into each clip 100. Other types of attachments can be made which are known in the art.

FIGS. 4 and 5 shows a trim assembly 102 being prepared for intuitive insertion and attachment to a part of a wall. In this non-limiting example, there are total of sixteen clips 100 surrounding two windows 184. Connecting the trim assemblies 102 to the clips 100 does not require any tools; hand pressure is sufficient, although a small hammer may be used in certain circumstances, if the size of the clip is such that hand pressure is not sufficient to secure the clips to the window structure and/or secure trim assembly 102 to the clips.

Figure 6:
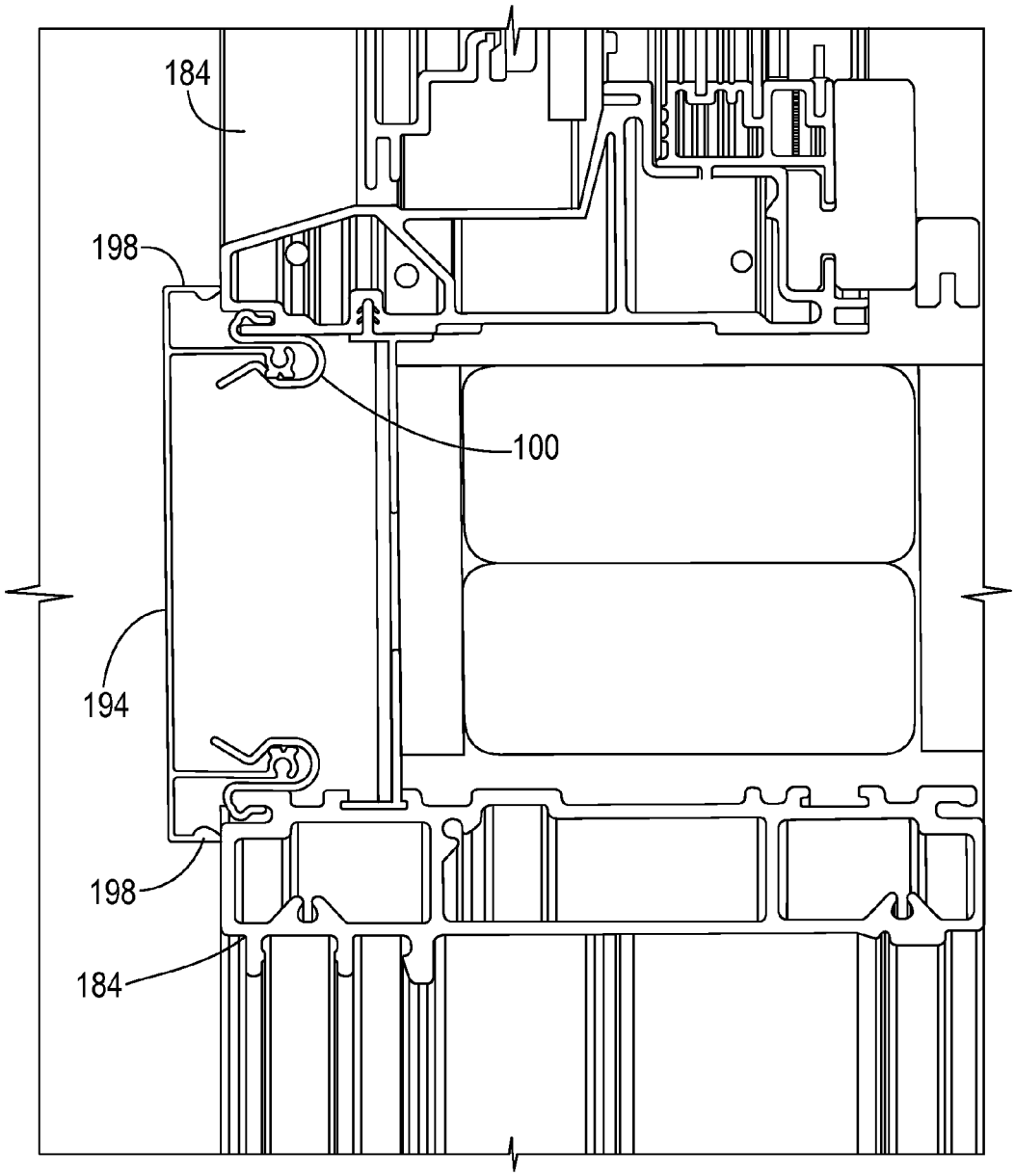
FIG. 6 is a cross-sectional view of trim in the installed position between a door and a window.

Referring to FIG. 5 and FIG. 6 a center trim member 194 that is secured to two separate windows 184. Trim member 194 includes a center panel member 196 and two side panel members 198 each a mirror image of one another. Side panel members 198 have a terminal end that contacts a respective window.

An installer positions the trim assembly 102 substantially parallel to the windows 184. The tabs 112 attached to the trim assembly 102 are pointed towards the windows 184 and are aligned with the clips 100 as shown in FIG. 4. The installer then moves the trim assembly 102 in the insertion direction 186 towards the clips 100 and applies pressure on all sides of the trim assembly 102 until each and all of the tabs 112 are securely enveloped by its corresponding clip 100.

In one embodiment, the pressure applied to the trim assembly 102 automatically centers the trim assembly 102 about the windows 184 and does not cause the trim assembly 102 to roll. Each clip 100 applies pressure through exerting spring forces along vectors 188, 190 as shown in FIG. 3, surrounding the tab 112. Spring force 188 acts to draw the trim assembly 102 toward the window structure 104 and building 176. Spring force 190 acts to draw the trim assembly in a general vector direction parallel to the outer surface of the building structure about the window structure 104. In this manner the trim assembly is centered about the window structure. For example if a window structure has four sides (top, bottom, right side and left side), the trim assembly formed from four separate trim components being secured at their ends with a corner connector would be centered about window structure 104.

This total assembly now seamlessly integrates with a previously placed weather resistant barrier and provides equal sightlines as shown in FIG. 6. The clip 100 may coordinate with a corner key 182 system as shown in FIG. 3 to keep the trim assembly 102 straight and the corner miter joints tight.

Once the trim assembly 102 is attached, there are no visible fasteners on the face or edges of the trim assembly 102. All clips 100 are hidden by the trim assembly 102 so there are not unsightly fasteners that may be seen once the trim assembly is secured. However, once attached, the trim assembly 102 can easily be removed by a user by simply pulling the trim assembly 102 away from the window structure 104 and building 176.

The removable trim assembly 102 will allow an installer to trial fit a trim length. A manufacturer has no control over where a customer installs these windows 184. Thus, a manufacturer can provide a generic trim length. An installer may cut the trim assembly 102 to match the field condition. Simple hand pressure in the reverse installation direction 186 will disassociate the trim assembly 102 from the clips 100. Since the clips 100 secure trim assembly 102 on the side that is not visible once the trim assembly is installed insertion and removal of the trim assembly does not mar the visible portion of trim assembly 102 in the installed position. This permits a user to easily remove and reinstall the trim assembly 102 if a window structure needs to be repaired or the surrounding building is being painted or other maintenance is being conducted where removal of the trim assembly 102 may be desirable. The easily removing of the trim assembly 102 will not damage painted surfaces.

The spring forces from clip 100 in vector directions 188 and 190 operates over a broader range of motion to reduce reliance upon trim cut to an ideal length. The spring force 188 applies a force towards the window structure 104. The spring force 190 also applies a force towards the second portion 108. These combined forces the tab 112 removably secure to the clip 100 within the cavity 110. The clip 100 will still self-center the trim assembly 102 if the pieces are cut longer or shorter than the ideal length.

Figure 7:
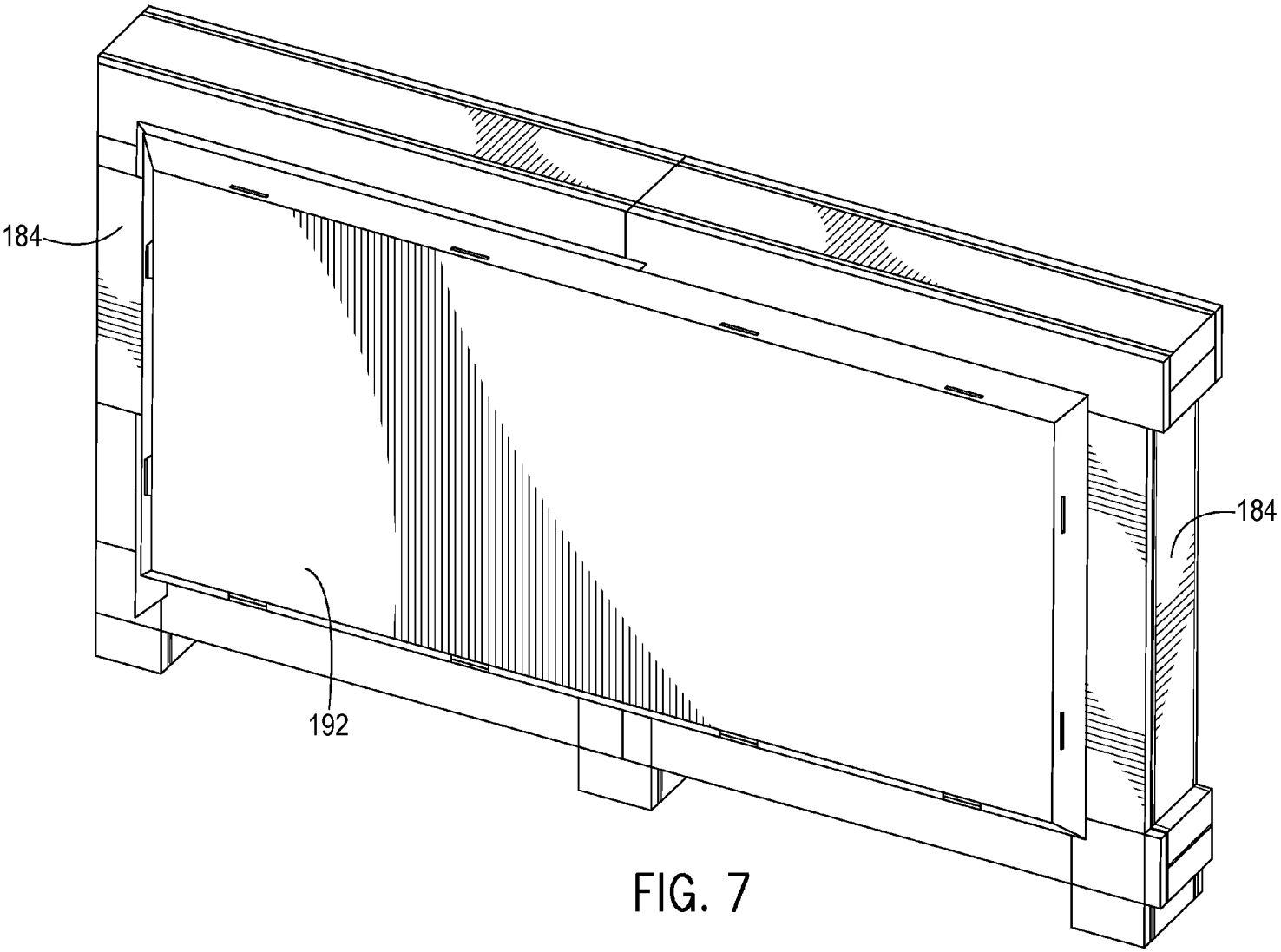
FIG. 7 is an isometric view of a mask covering secured to a building.

Referring to FIG. 7, an embodiment in which a mask 192 may be installed on the window structure utilizing the clips prior to installing the trim assembly 102. This will allow painting with a removably secure mask covering window 184 and other areas as necessary. Mask 192 includes a tab structure similar to tab 112 allowing the mask to be releasably secured to the window structure utilizing the clips 100. A painter may then paint the building structure without worry of getting paint on the window structure. Once the painting is completed the mask is removed simply by pulling the mask away from the building and window structure such that clips 100 release the tabs 112 on the mask. The trim assembly 102 may then be secured to the window structure using the same clips in a manner described above.

Figure 8:
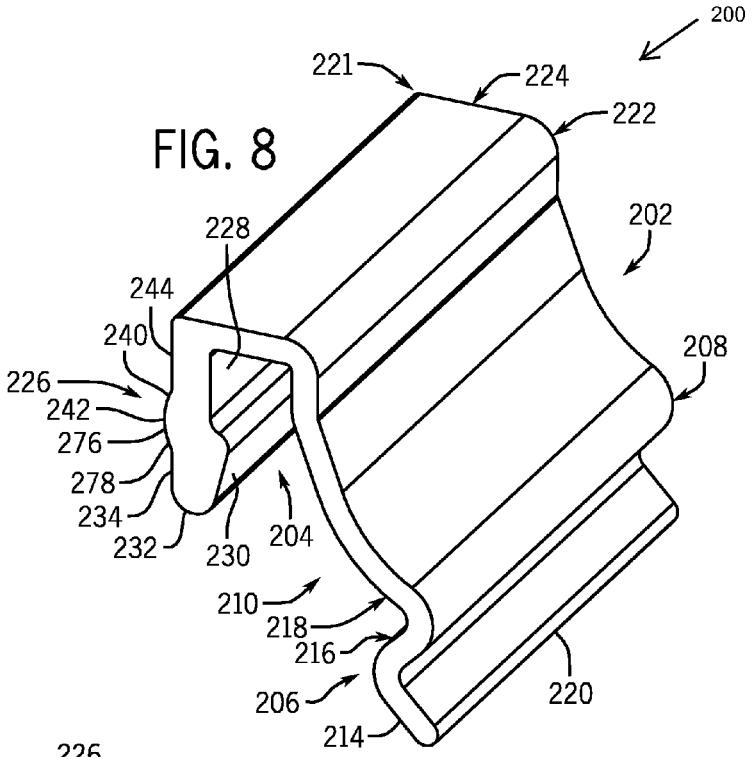
FIG. 8 is a side view of a second embodiment of the clip.
Figure 9:
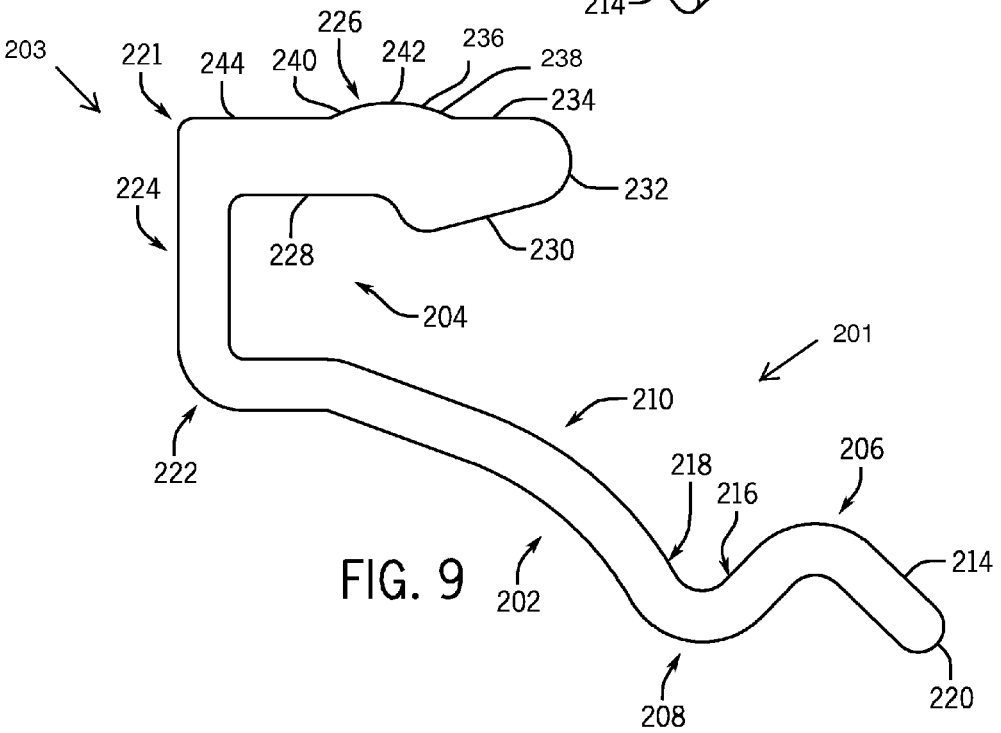
FIG. 9 is an angled and 3-D view of the second embodiment of the clip.

A second embodiment of a clip 200 is shown in FIGS. 8 and 9. Clip 200 includes a first section 201 and a second section 203. First section 201 is configured to releasably secure trim assembly 102 and second section 203 is configured to be releasably secured to window structure 104.

First section 201 includes a wavy handle portion 202. Second section 203 includes a generally U shaped member defining a channel 204. This embodiment also releasably secures a trim assembly 102 to an architectural element such as a window structure 104. In this embodiment, clip 200 is also molded or formed as a one-piece device. The channel 204 is designed to releasably secure post 156 window structure 104. The wavy handle portion 202 is made up of a first tooth portion 206, a second tooth portion 208, and a C-shaped portion 210. The first tooth portion 206 generally extends n the same direction as the C-shaped leg portion 210 toward second portion 203. The first tooth 206 includes a first leg portion 214 connected to a second leg portion 216. The second tooth 208 generally extends in a direction opposite to that of first tooth 206 and C-shaped portion 210 in a direction away from second portion 203. Second tooth 208 is formed includes the second leg portion 216 from first tooth 206 and a first end 218 of the C-shaped leg portion 210.

Referring to FIGS. 8 and 9, an L-shaped segment 221 and second end 222 of the C-shaped leg portion 210 defines a channel 204. L-shaped segment 221 includes a base 224 connected to a finger portion 226 that extends from base 224. Finger portion 226 has an interior surface first wall 228 that defines part of the channel 204. An interior second wall 230 extends from first wall 228 in a direction away from base 224 and wavy handle portion 202. Second wall 230 bends away/outward from handle portion 202. Second wall portion 230 terminates in a free end or rounded tip 232. Extending from rounded tip 232 on the exterior surface of clip 100 is a third wall 234. Extending from third wall 234 is a hump 236 that extends outwardly from finger portion 226 in a direction away from channel 204. Hump 236 may be formed from two shallow ramps 238, 240 and a flat surface 242 as shown in FIGS. 8 and 9. Alternatively, hump 236 may be a generally convex portion extending outwardly from exterior surface 244, away from channel 204.

Figure 13:
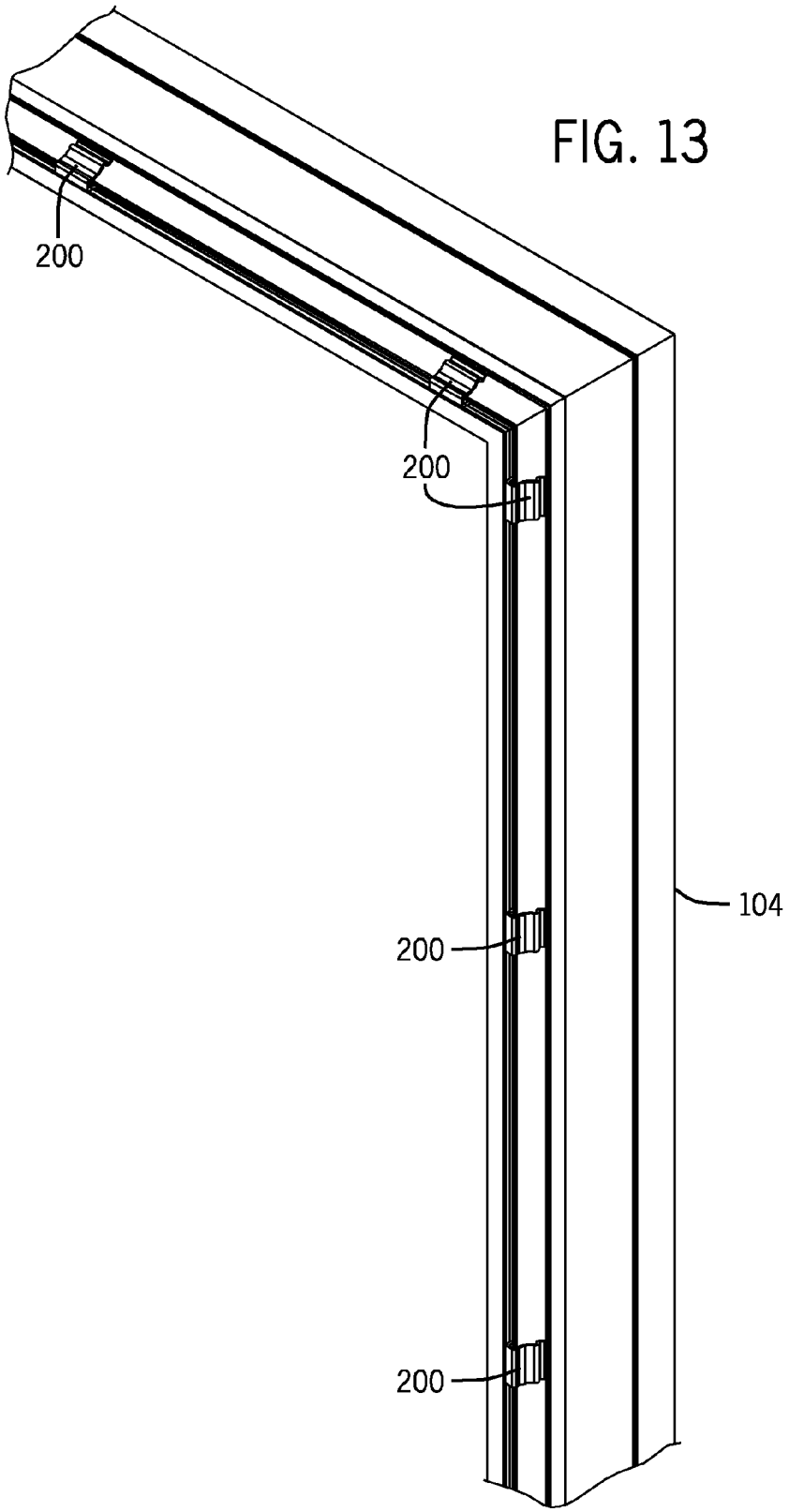
FIG. 13 is a front-angled-corner view of multiple clips attached to a window.

The wavy handle portion 202 of clip 200 provides flexibility that allows for the insertion of post 156 into channel 204. C-shaped portion 201 acts to guide post 156 into channel 204. The combination of the C-shaped leg portion 210 and the second wall 230 provide funnel guidance for the post 156 is easily inserted into channel 204. Referring to FIG. 10, the post 156 is mated with channel 204, similar to mating with bay 148. The clip 200 is removably secured to window structure 104 by a user without the need for any tools. A user simply pushes channel 204 toward the post 156 until post 156 is received within channel 204. The friction provides a static or stable connection for the clip 200. Referring to FIG. 13, clips 200 are spaced about window assembly 104 to receive trim assembly 102.

Once the clips 200 are attached to the window post 156, the trim 102 is ready to be installed. As shown in FIG. 10, the trim 102 is lined up the clips 200 surrounding the window 104. Within the trim 102, there are channels 260 designed to mate each clip 200. Adjacent to each channel 260, a leg portion 262 bends contrary to the channel 260. This leg portion 262 also provides funnel guidance for each clip 200. When the trim 102 is hand pressed towards 264 the second tooth 208 and the extension 220 of clip 200 embed themselves in channel 260 as shown in FIG. 10.

Figure 12:
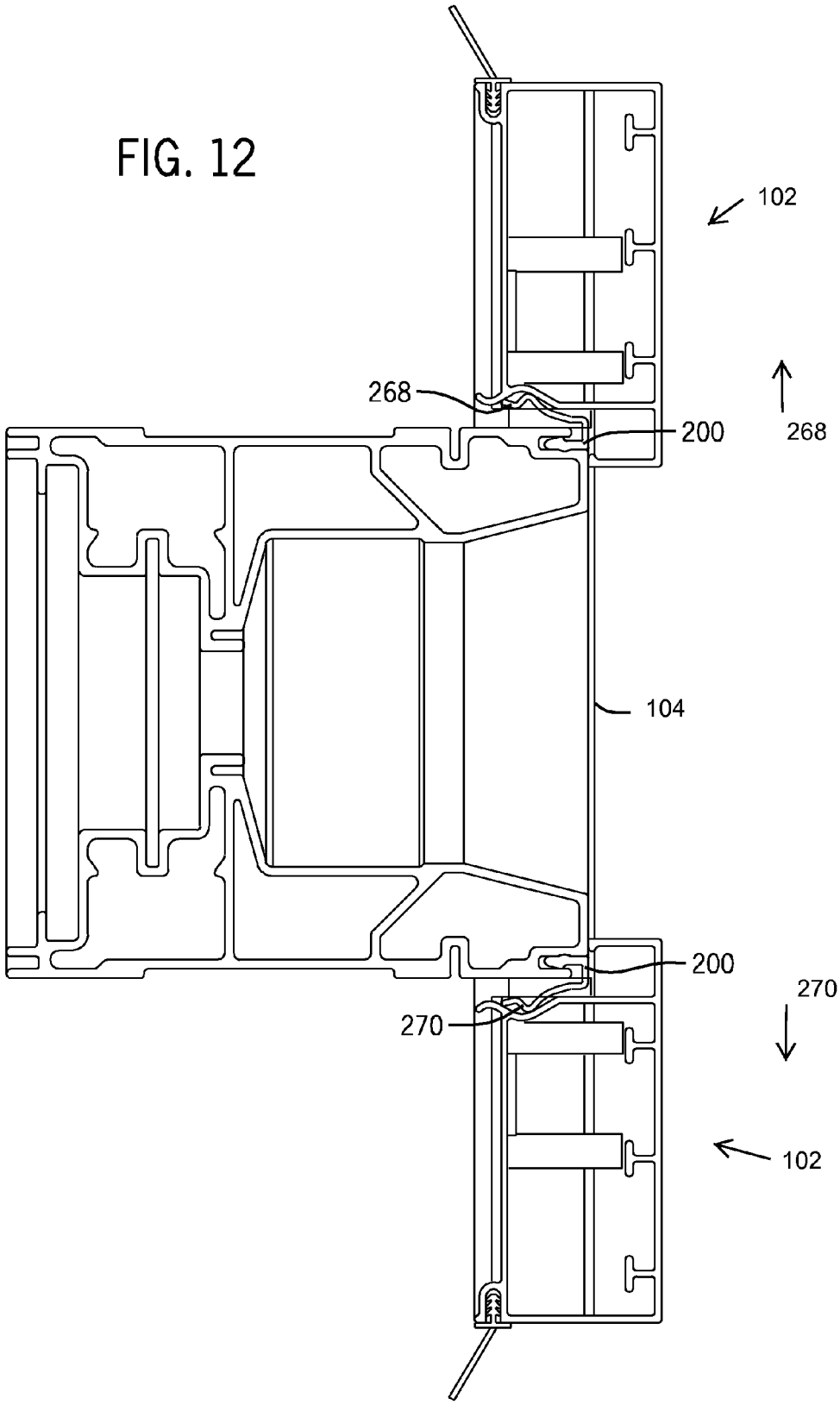
FIG. 12 is a top view of a trim piece inserted and attached to a clip and window using a second method for contact with the clip.

Referring to FIG. 12, trim assembly 104 is shown attached to two opposing sides of window structure 102. Portion 202 of clip 200 provide a biasing force in a direction away from the window structure. One clip 200 shown on the right side of window structure in FIG. 12 provides a force against trim assembly 102 in a rightward direction shown as vector 268. Similarly, the clip 200 shown on the left side of window structure 104 in FIG. 12 provides a force against trim assembly 102 in a leftward direction shown as vector 270. In this manner clips 200 provide equal and opposite force against trim assembly 102. This equal and opposite force helps to center trip assembly 102 about window structure 104. FIG. 12 also shows the mirroring of clips 200 in relationship to the trim 102. Since the clips 200 are mirrored, there is equalized force both horizontal right 268 and horizontal left 270.

While FIG. 11 illustrates the rightward and leftward acting on trim assembly 102, there are also clips providing upward and downward forces on trim assembly 102 as well. As shown in FIG. 13, clips 200 are mounted both horizontally and vertically. Thus, the same principles that stabilize the horizontal movement as discussed previously, also apply to the stability of vertical movement.

Since trim assembly 102 generally covers all four sides of a window structure, the trim assembly is generally centered about window structure 104 in the up, down, left and right directions. Of course it is contemplated that the window structure may have other shapes than a square shape. If window structure has less or sides, than clips 200 provide opposing forces that would assist in the centering of the trim assembly on these window structure shapes as well.

Referring to FIG. 12, in an alternative embodiment, only second tooth 208 of clip 200 is located within channel 260. First tooth 206 is in contact with a bulge 266 of trim assembly 102. In this embodiment, bulge 266 is nested with tooth 206 further retaining trim assembly 102 against window structure 104 by clips 200.

The trim assembly 102 no longer dictates where an installer places the window 184 or a door in a wall of a building. Rather, it is expected that a 'common geometry' or modularity will be established. This flexibility allows an installer to install the same trim assembly 102 across adjacent windows 184 and doors. The clip 100 allows a manufacturer to utilize the same trim on different windows 184 and door product lines. Simply through designing a new clip 100, a manufacturer can utilize existing trim on different windows 184 or door product line. The clip 100 removes the complexity present in some trim solutions.

It takes minimal if any training to snap the trim assembly 102 into the clip 100. Since the clip 100 is intuitive to understand and install than current solutions, industry adaptation is easier. An installer can cut pieces of trim to length and assemble them onto an installed windows 184 or door or combinations thereof.

An advantage to using the clip 100 is an installer may attach the trim assembly 102 after painting is complete. A painter does not need to staple through a weather resistant barrier. A second advantage is each assembly may have its own packaging to protect it during shipping. With smaller packages, it is easier to make the packages fit a delivery vehicle.

It is noted that trim assembly has been identified by reference numeral 102 for use with clip 100, 200 and in the embodiment illustrated in FIG. 12. Although trim assembly has been identified by reference numeral 102, it is understood that the trim assembly has a different geometry when being used with clips 100, 200 and as illustrated in FIG. 12.

In one embodiment groove 151 extends substantially along the entire width and length of window structure 104 where trim assembly 102 is to be secured. Similarly, wall or post 156 also extends substantially along the entire width and length of window structure 104 where trim assembly 102 is to be secured. This allows clips 100 or 200 to be placed anywhere along the width or length of window structure 104. It is also contemplated that groove 151 and corresponding post 156 may be located in discrete locations such that the location of clips 100 or 200 would be releasably secured to window structure 104 in predetermined positions.

In one embodiment trim assembly 102 has four side pieces forming a square or rectangle. Each of the side pieces may be secured to an adjacent side with a corner attachment member. In one embodiment, each side piece is perpendicular to an adjacent side piece. When trim assembly 102 with the four side pieces secured together with corner attachment members is removably secured to window structure 104, clips 100 bias each side piece in a direction toward the center of the window that is generally parallel to the window glazing. Stated another way, clips 100 bias each side piece in a direction away from the side piece that is parallel to itself. Since the side pieces of trim assembly 102 are secured to one another the equal and opposite biasing of the assembly trim pieces by clips 100 both center trim assembly about window structure 104.

In the embodiment described above with respect to clip 200, each side piece is biased in an direction away from the center of the window that is generally parallel to the window glazing and in a direction away from the side piece that is parallel to itself. Since the side pieces of trim assembly 102 are secured to one another the equal and opposite biasing of the assembly trim pieces by clips 100 center trim assembly 102 about window structure 104.

In other embodiments, there may be an odd number of side pieces such that at least one side piece is not parallel to another side piece. This could include a trim assembly having a triangular shape, arcuate shape, circular shape, or a shape having more than four straight or arcuate sides/portions. In this type of embodiment, clips 100 bias the each side piece in a vector direction toward from the center of the window in a direction generally parallel to the window glazing. The vector directions however will balance each other such that a trim assembly having non parallel side pieces will be generally centered about the window structure. Similarly, in this type of embodiment, clips 200 bias the each side piece in a vector direction away from the center of the window in a direction generally parallel to the window glazing. The vector directions however will balance each other such that a trim assembly having non parallel side pieces will be generally centered about the window structure.

Clips 100 as discussed above provide a biasing force in a direction toward the center of the window in a direction generally parallel to the window glazing as well as a biasing or retention force that biases trim assembly inwardly toward window structure 104 in a direction generally perpendicular to the window glazing. Similarly, Clips 200 as discussed above provide a biasing force in a direction away the center of the window in a direction generally parallel to the window glazing as well as a biasing or retention force that biases trim assembly inwardly toward window structure 104 in a direction generally perpendicular to the window glazing.

It is important to note that the construction and arrangement of the window and door trim clip as described herein is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature of number of discrete elements or positions may be altered or varied. Additionally, other trim and or clip geometries are contemplated. For example, other clip designs that provide opposing forces about the window structure may be used to mate, secure or bias different trim assembly geometry. Accordingly, all such modifications are intended to be included within the scope of the present invention to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims

What is claimed is:

1. A window and trim assembly system comprising:

a window structure including a window frame having a first longitudinal edge and a second opposing longitudinal edge;

a trim assembly surrounding a periphery of the window structure having a decorative surface and an opposing surface having an engagement portion, the trim assembly having a first portion proximate the first longitudinal edge and a second portion proximate the second longitudinal edge;

a first clip being releasably engaged with the window structure adjacent the first longitudinal edge and a second clip being releasably engaged with the window structure adjacent the second longitudinal edge;

the first clip and second clip releasably securing the trim assembly to the window structure, the first clip biasing the first portion of the trim assembly in a first direction and the second clip biasing the second portion of the trim assembly in a second direction opposite to the first direction;

the first clip and second clip being releasably engaged with the window structure and trim assembly without a fastener or tools; and each engagement portion including a first surface and a second separate surface;

the first clip biasing the first surface of the engagement portion of the first portion of the trim assembly a first direction generally parallel to a plane defined by a glazing of the window structure and biases the second separate surface of the first portion of the trim assembly in a second direction generally perpendicular to the plane defined by the glazing;

the second clip biases the first surface of the engagement portion of the second portion of the trim assembly opposite the direction generally parallel to the plane defined by a glazing of the window structure and biases the second separate surface of the second portion of the trim assembly in the second direction generally perpendicular to the plane defined by the glazing.

2. The window and trim assembly of claim 1, wherein each clip biases the trim assembly in two vector directions including a direction generally parallel to a plane defined by a glazing of the window structure and a second vector direction generally perpendicular to the plane defined by the glazing.

3. The trim assembly of claim 2, wherein the engagement portion of the frame assembly includes a tab, a first portion of each clip includes a cavity configured to receive the tab.

4. The window and trim assembly of claim 3, wherein a second portion of each clip includes a U-shaped portion received within an engagement member of the window structure.

5. The window and trim assembly of claim 4, wherein the second portion of each clip contains a tooth portion biasing the trim element in the first vector direction and the second vector direction.

6. The window and trim assembly of claim 5, wherein a configuration of the clip and a material of the clip provide a spring force when engaged with the window frame and trim assembly.

7. The window and trim assembly of claim 6, wherein the spring force allows inserting and removal of the trim member in relation to the clip by hand.

8. The window and trim assembly of claim 7, wherein a surface area of the second portion is configured to engage the window frame.

9. The window and trim assembly of claim 8, wherein a concave side of a bend portion of each clip is receptive to a matching geometric member within the engagement member.

10. The window and trim assembly of claim 1, wherein one end of each clip provides funnel guidance for a tab of the trim assembly.

11. The window and trim assembly of claim 1, wherein the trim assembly includes a first frame member and a frame lineal member separate from the first frame member and secured together with a corner key.

12. A trim assembly comprising:

a trim member forming a frame having an outer periphery configured to surround an outer periphery of a fenestration opening, the trim member having an inner trim assembly having a decorative surface and an opposing surface having a mating member in a direction away from the decorative surface;

at least two clips, each clip having a first portion configured to be releasably secured to a fenestration structure and a second portion releasably secures to the mating member when the trim member is properly positioned substantially parallel to a plane defined by the fenestration opening; and wherein, when the mating members are pressed against the clips, the clips are able to removably secure the trim member to the fenestration structure;

wherein each clip biases the trim assembly in two vector directions including a first vector direction generally parallel to the plane defined by the fenestration opening and a second vector direction generally perpendicular to the plane defined by the fenestration opening, wherein one of the at least two clips biases the trim assembly in the first vector direction and a second of the at least two clips biases the trim assembly opposite to the first vector direction.

13. The trim assembly of claim 12, wherein the trim member provides a weather resistive barrier and provides equal sightlines when the mating member is engaged with the clips.

14. The trim assembly of claim 13, wherein the mating member extending substantially throughout the entire frame.

15. The trim assembly of claim 14, wherein a portion of the mating member is received within a cavity of each clip.

16. The trim assembly of claim 12, wherein the combining of the clips with the mating members of the trim provide opposite force vectors that stabilize the trim assembly.

17. The trim assembly of claim 16, wherein the mounting of the first clip mirrors the mounting of a corresponding second clip.

* * * * *